United States Patent [19]

Grace et al.

[11] 4,247,191

[45] Jan. 27, 1981

[54] PROJECTION COLOR COPIER

[76] Inventors: Archie R. Grace, 115 Avenue Rd., Clarence Garden; Robert J. Grace, 42 Kintore Ave., Prospect, both of Australia

[21] Appl. No.: 50,545

[22] Filed: Jun. 21, 1979

[30] Foreign Application Priority Data

Jun. 28, 1978 [AU] Australia ..... PD4895

[51] Int. Cl.[3] ..... G03G 15/01

[52] U.S. Cl. ..... 355/4; 118/645; 118/662; 354/317; 355/10

[58] Field of Search ..... 355/4, 10, 16; 118/645, 118/647, 644, 660, 662; 430/117-119; 354/317

[56] References Cited

U.S. PATENT DOCUMENTS 3,650,620 3/1972 Hoyt ..... 355/16 X 3,790,375 2/1975 Brock ..... 355/10 X 4,149,798 4/1979 McGowan et al. ..... 355/3 R

*Primary Examiner*—R. L. Moses

*Attorney, Agent, or Firm*—J. Harold Nissen

[57] ABSTRACT

A color copier having a carriage with a platen thereon arranged to engage and hold an electro-photosensitive receptor member movable between a light exposure station having a set of selectable filters of different-color values to project a series of monochromic images from a multicolored master onto the receptor members and a series of developer stations each arranged to contain a developer of a different color but complementary to the color values of the filters, each developer station including a developer plate arranged to be wetted by the developer prior to pressing the developer plate to the receptor member to develop the image thereon, and means to remove excess developer.

10 Claims, 4 Drawing Figures

PROJECTION COLOR COPIER

This invention relates to a projection copier, including micrographics.

BACKGROUND AND OBJECTS OF THE INVENTION

Microfilm and microfiche are used extensively for storage and reproduction of records and, because of the space saving which results, the trend to keep matter which has to be stored for subsequent examination is increasing. The invention is not limited to micrographics.

There are various forms of microfilm and microfiche scanners on the market which simply project an image at the required increased scale onto a ground glass screen or similar surface so that the material can be viewed.

It is also known to provide projectors which allow copying of the microfilm or microfiche on a readable scale, and according to an earlier invention of ours such a copier comprises an adaption unit which can be fitted to a normal copier and which will then allow the microfiche or microfilm data to be reproduced by the copier, the usual copiers being of the electrostatic type in which the medium such as paper on which the copies are to be produced is fed through the machine, a light image being projected from the microfilm or microfiche onto a sensitized member which then has the image so produced developed on the member and if required transferred to a receiving sheet.

The accent has been on the production of monochrome copies but it is now found necessary to be able to copy colour images for which the monochrome copiers are not suitable, and it is an object of this invention to provide an improved copier which will be able to enlarge the image from a microfilm or microfiche to a readily readable size and to reproduce the image in colour.

A purpose for which such a device is usuable is for instance for medical study where the information stored must be of correct colour rendition for diagnostic purposes. It is thus an object of the present invention to provide a unit which will be able to reproduce pictures of the required size from coloured microfilm or microfiche sources.

It is already known to produce colour images by overprinting, in which case the image is projected through a filter of a selected colour and is printed in that colour, and, after drying, a second colour image is produced of a further selected colour and overprinted onto the first printed image and so on until the necessary total colour rendition results, it being customary for instance to use red, blue, and yellow overprints preferably with a black overprint to produce the dark shades where required. Such methods are generally satisfactory, but in the heretofor known devices it has been difficult to maintain correct and exact register, and also to achieve an effective colour rendition. It is therefore a further object of the present invention to provide a device in which succeeding images will be correctly registered and of correct colour.

SUMMARY OF THE INVENTION

The projection colour copier comprises a carriage to support an electrosensitive reception member arranged to have a light image selectively modify the electrical pattern thereon, an exposure station having a set of selectable colour filters and a light source and a lens system to project a monochromic image from a coloured master to the reception member, a series of developer stations each arranged to contain a developer of a different colour but selected to match the colours of the filter, whereby each coloured monochromic image is developable by the developer of the selected complementary colour, each developer station containing a platten arranged to be wetted by the developer prior to pressing the platten to the receptor member to develop an image thereon, means being included to successively move the carriage to the exposure station and to charge the surface of the receptor member as it moves to the exposure station, control means being also included to energize the light source and select the filter whereby a monochromic image is projected and to then move the carriage to the selected developer station and press the platen to the receptor sheet.

The control means ensure that the sequence of operation is to move the carriage to pick up the receptor sheet, move it to the exposure station and charging it during such movement, selecting a first colour filter and exposing the charged receptor sheet to a monochromic image pattern, then moving the carriage to a first developer station which is complementary to the first filter and pressing the receptor sheet to the previously wetted platen, removing excess liquid from the receptor sheet and returning it past the charger to the exposure station where a second filter is selected and a further exposure made, and so on until the final filter and complementary colour developer is applied, after which the carriage, after the image again has excess developer removed, is moved to the discharge locality and the receptor sheet discharged, the sheet now having the required number of overprints applied to reproduce the original colour master.

PREFERRED EMBODIMENT

Figure 1:
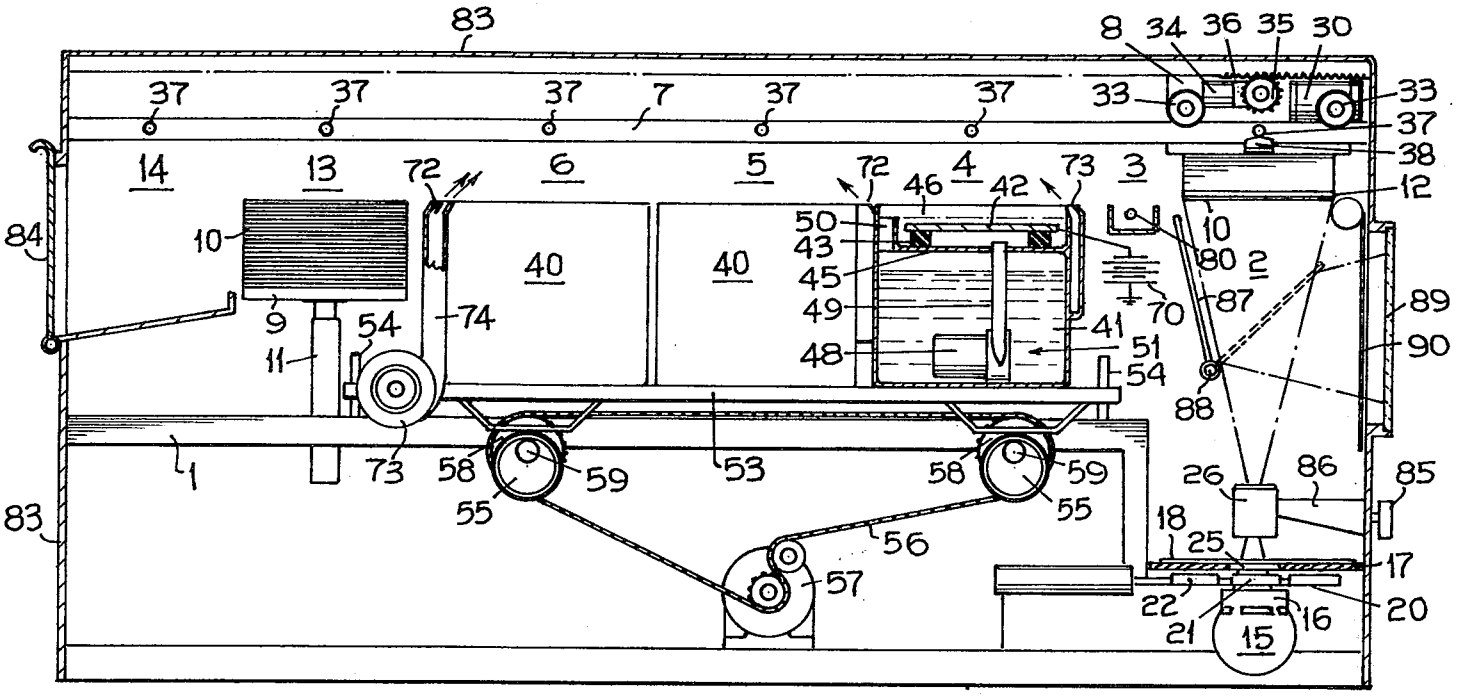
FIG. 1 is a longitudinal section, somewhat schematic, of a colour copier according to this invention.

The invention comprises a main frame 1 which supports various mechanisms defining an exposure station 2, a charging station 3 and a series of developer stations 4, 5 and 6, a track 7 having on it a movable carriage 8 being also supported on the said frame 4. A holder 9 for a stack of paper sheets 10 is also carried on the frame 1 by a mechanism 11 which can feed paper as required to a platten 12 on the carriage 8 so that the paper can be moved from the feed locality 13 to the exposure station 2 and then to the developer stations 4, 5 and 6 and subsequently to a discharge area 14.

The exposure station 2 comprises a light source 15 and condenser lens 16 positioned behind a table 17 which carries a transparency 18 such as a microfilm, a set of filters 20, 21 and 22, which for colour printing are green, red, and blue filters, intercept the light from the light source 15 to give a monochromic image from the coloured transparency 18 placed onto the table 17 over a window 25 so that an image can be projected through the lens 26 on to a receptor sheet, in this case the paper sheet 10 on the platen 12.

The platen 12 is of the suction type and has a multiplicity of holes 27 (see FIG. 2C) through it, the back of which platen connects to a suction chamber 28, to which suction is supplied from a pump 29 driven by a motor 30 carried on the carriage 8 to move with the carriage, thus allowing the platen 12 to pick up the paper 10 on which a colour image is to be developed.

The carriage 8 has wheels 33 which engage the rails 7, which rails 7 extend from the exposure station 2 to the paper discharge area 14, a motor 34 driving a pinion 35 through a gear box 36, which pinion 35 engages a rack 36 disposed adjacent to the rails so that the carriage 8 can be driven along the rails as required, indexing switches 37 being provided along the rails so that when the trip 38 on the carriage actuates any one of these indexing switches it can be stopped, the indexing switches 37 allowing the carriage 8 to be stopped either to pick up paper 10 from the stack or to hold the carriage 8 at the exposure position in an exact register with the mechanism of the projection station, 2 or it can be stopped at any of the developer stations 4, 5 and 6.

Each of the developer stations 4, 5 and 6 comprises a tank 40 which contains developer of a required colour in a lower part 41 of the tank, but in each of the tanks is a developer plate 42 held by resilient supports 43 so that it can be pressed down against loading pressure but normally is accurately located in the tank to be parallel to the platen 12 which carries the paper 10 on which development is to take place. The resilient supports are carried on a wall 45 which forms the floor of an upper compartment 46 in which the platen 42 is isolated.

Figure 2:
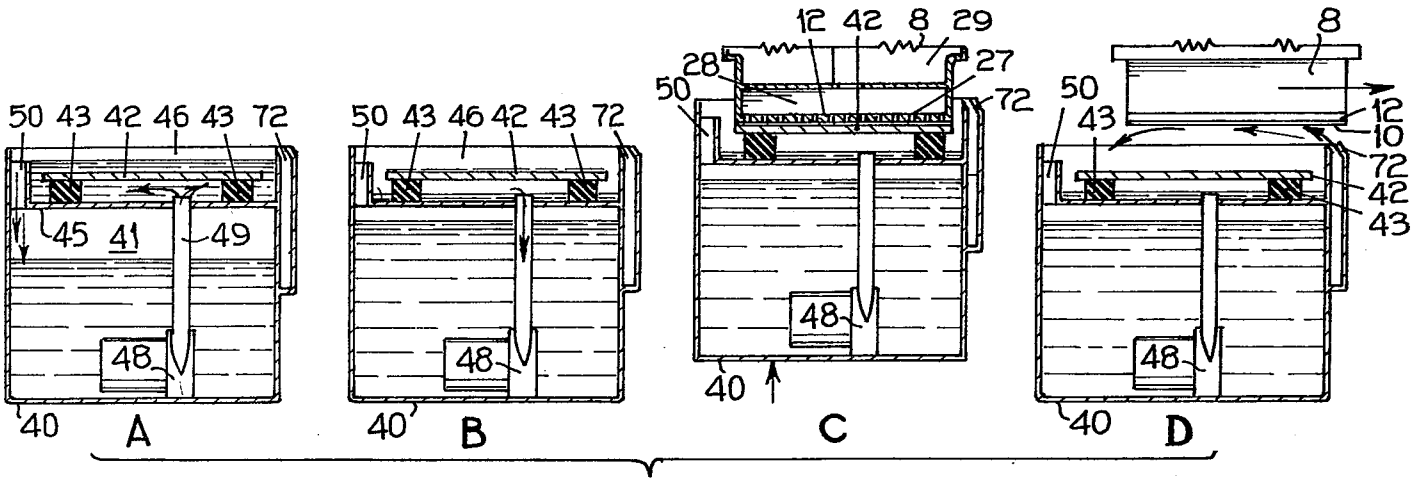
FIG. 2 is a longitudinal section of one of the developer stations, showing at A how the developer is pumped to wet and wash the platen in readiness to develop an image, showing at B how the developer is drained to leave the platen charged with a film of developer, showing at C how, after wetting the platen, the developer tank is raised to cause the platen to press against the receptor member, and showing at D the developer tank lowered and the carriage moving away with an air knife removing excess developer from the receptor member.

Each tank is provided with a submerged motordriven pump 48 connected by a pipeline 49 to the upper tray 46 of the tank 40 and has an overflow line 50 which has its inlet for return purposes disposed some distance above the developer platen 12, the arrangement being such that when the platen is to be charged with developer, the pump 48 in the tank 40 is actuated to pump liquid developer 51 into the tray 46 until it overflows down the overflow line 50, at which stage the developer plate is fully submerged in the liquid as shown at FIG. 2A.

In use, however, just prior to the carriage 8 being moved over such a developer zone, the pump 48 is stopped and the liquid is allowed to drain back through the pump to a level below the developer plate 42 so that while the plate 42 is wetted with developer, the liquid supply is well below the developer plate, see FIG. 2B.

The tanks 40 are mounted on a frame 53 which is located on vertical guides 54 and this frame contacts cams 55 which are supported in bearings on the main frame 1 and are driven by means of a chain 56 from a motor 57 so that the tanks can be raised by actuating the cams, the chain 56 passing around sprocket wheels 58 on shafts 59 which also support the cams 55.

The purpose of this is to move the tanks 40 upwardly when development is to take place, see FIG. 2C, and the arrangement is such that when the carriage 8 is positioned above one of these tanks 40 during a developing operation, the tank 40 is moved upwardly and the wet developer plate 42 presses against the paper 20 which is carried on the platen 12 of the carriage 8 to transfer developer to those areas where the latent electrostatic image allows this. A bias is applied to the developer plate 42 which can be achieved by insulating the plates 42 from earth by the supports 43 so that a charge exists on them due to transfer from previous contacts with the paper containing the latent electrostatic image, but preferably a relatively high bias of perhaps 100 volts is applied from a supply arrangement 70 to ensure that transfer of developer will take place only at those areas where the latent image exists on the paper being developed.

An air knife 72 on each of the tanks expresses liquid from the paper 10 on the platen 12 should any excess be present, the air knife 72 of a particular tank being actuated as the tank 40 is lowered and the carriage 8 commences to move away from the area of the tank 40, a fan 73 and ducting 74 being used as shown on the tank 40 at the developer station 6 at FIG. 1. The air knife is actuated as the carriage returns to the charging station.

Figure 4:
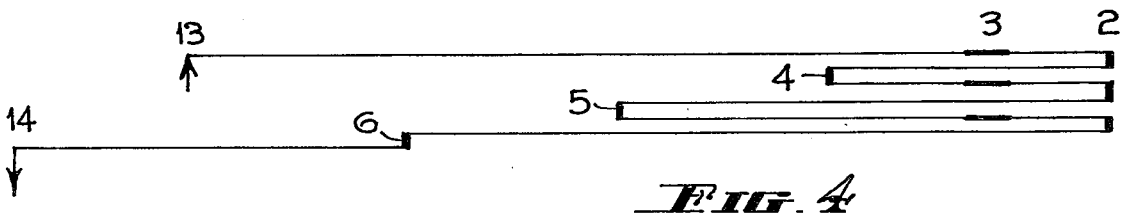
FIG. 4 is a schematic view showing the travel of the carriage to and from the various stations.

The operation will now be described with reference to FIG. 4.

The carriage 8 is moved to a pick-up station 13 where the paper 20 on which the image is to be produced is stacked on the holder 9, the paper being coated with a suitable sensitizing agent such as zinc oxide set in a resin matrix so that an electrical light-modified image can be produced thereon.

The carriage 8 picks up the paper on the platen 12 from the holder 9 which moves the paper against the platen which has suction applied to it from the pump 29, FIG. 2C, at that stage so that the paper is held firmly against the platen and the carriage is then moved to the exposure locality where it is stopped accurately by register means 37, and a light exposure is made through the master 18 through one of the monochromic filters, say the green filter 20, which then leaves an electrical image to be developed by a magenta coloured developer held in the tank 40 at the developer station 4, the carriage 8 in its movement from the paper stack to the exposure station 2 moving over the charger 80 which is activated at that stage so that the photoconductive surface on the paper is electrically charged prior to the monochromic light exposure.

The carriage 8 is now moved back along the rails 7 by the motor 34 with the charger de-energized so that now the light-modified image only exists on the paper 10 on the platen 12 and the carriage 8 is stopped at the developer station 4 which, as said, contains a magenta coloured developer.

However, prior to the carriage reaching the exposure station 2 the developer circulating pump 48 in the developer station 4 is switched on (FIG. 2A) so that while exposure is taking place the developer plate 42 is submerged in the magenta coloured developer liquid, and, after exposure, before the carriage 8 reaches the developer station 4 the developer is allowed to drain back (FIG. 2B) leaving the developer plate 42 wetted with developer. When the carriage is located above this plate the motor 57 is operated to raise the developer tanks 4, 5 and 6 to press the developer plate 42 of the tank at station 4, firmly against the paper on the platen 12 while applying an assisting bias between the developer plate and the platten (FIG. 2C).

Immediately development is completed the tank at station 4 is lowered (FIG. 2D) and air is forced from the air knife 72 over the face of the paper 10 on the platen 23 to expel any excess developer still adhering to the paper, the air knife action continuing until the carriage is returned to the exposure station 2, and during this return the photoconductive surface is again charged by passing over the charger 80.

An exposure is now made through say the red coloured filter 21 and when this is completed the carriage 8 is moved to the cyan coloured developer contained in the developer tank at station 5 and the same procedure follows this developer having also wetted the developer plate by flooding the upper compartment 46 of the tank 40 to the height of the overflow 50, and as the carriage 8 returns to the exposure station 2 the air is forced from the air knife 72 on the developer tank 40 at station 5 to again denude the paper 10 on the platen 12 from any excess developer remaining in place, the carriage again passing the paper over the charger 80 before locating it at the exposure station 2.

An exposure is now made through the remaining colour filter 22 which, for instance, can be a blue filter, and after exposure the carriage 8 is moved to developer station 6 where again the same procedure follows in that the developer plate has been wetted with the yellow developer liquid held in this tank and then allowed to drain to leave only a wetted surface on the developer plate and the tanks are again moved up by operating the motor 57 to press the wetted developer plate on to the paper 10 on the platen 12 of the carriage.

If only a three-colour system is used as shown in the illustration, the three colours have now been applied to the paper and the paper is then taken to the discharge locality 13 by moving the carriage over the air knife 72 after the tanks are lowered, this final air knife preferably including means to ensure that the image is completely dry, such as heating means, and the developed paper containing a tri-colour image overprint lodges on the receiving tray 82.

During all of this processing light is excluded from within the copier by the walls 83 extending around the mechanism, but a door 84 is provided to give access to the finished copy material and also for charging the holder 9 with further sheets of paper when required.

To allow the image to be effectively focused, a knob 85 is associated with the mount 86 which carries the lens 26, and to allow accurate visual focusing a movable mirror 87 hinged at 88 to the frame can be swung down to the dotted-line position shown in FIG. 1 to then project the image on to a ground glass screen 89 or similar translating device.

Figure 3:
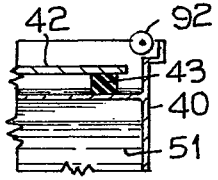
FIG. 3 is a fragmentary view of a developer tank showing a squeegee roller in place of an air knife.

After focusing the mirror 89 is moved from its dotted-line position back to the full-line position shown and the exposures can proceed. It is of course necessary to prevent light entering the machine through the screen 89 during exposure and processing, such as by a blind 90. In FIG. 3 the air knife is replaced by a squeegee roller 92.

Obviously instead of using only three developer tanks a different number could be used, such as by including a tank with black developer, or in some cases it may be desired to use more or less colours than the three shown.

Because the carriage 8 moves on a fixed path it is a simple matter to achieve the required register of the carriage at the exposure station 2 which is critical because each colour image must be registered exactly with the previous image and this of course can be readily achieved in that the image is projected from a stationary projection on to the platen 12 on the carriage 8 and the carriage can be readily indexed in relation to the image by detent or other means which engage the table and ensure that it is exactly aligned, such as by the switch 37 and trip 38.

The image can of course be projected from any original such as in general with photocopiers, provided the usage is projected onto a photo-receptor member where an electrical image is then established for development by an electrically sensitive developer. It is preferable to use a lens with a minimum of 20% reduction from the original side when not using micrographics so as to avoid likelihood of copying from bank notes and other valuable documents.

Instead of using the colour filters referred to under numbers 21 and 22, dichroic filters can be used which have a more accurate colour cut-off.

We claim:

1. A colour copier comprising:

(a) a carriage having a platen thereon arranged to engage and hold an electro-photosensitive receptor member having a surface arranged to have a light image selectively modify an electrical pattern thereon;

(b) means to charge the said surface;

(c) an exposure station having a set of selectable filters of different colour values and a light source and lens system to project a series of monochromic images from a multicoloured master on to the said receptor member;

(d) means to energize the said light source to expose the said receptor member to a monochromic image of a selected colour;

(e) a series of developer stations each arranged to contain a developer of a different colour but selected to be complementary to the colours of the said filters, whereby each monochromic image is developable by a developer of the selected complementary colour;

(f) a developer plate at each developer station arranged to be wetted by the said developer prior to pressing the developer plate to the said receptor member to develop an image thereon;

(g) means to move the said carriages between the said stations and to charge the said receptor member before reaching the said exposure station and to remove excess developer from the said receptor member as the said carriage transports the said receptor member from the said developer stations.

2. A colour copier according to claim 1 characterised in that the said charger is positioned adjacent the said exposure station and is energized as the said carriage approaches the said station to progressively linearly charge the said receptor member.

3. A colour copier according to claim 1 or 2 characterised in that each developer station comprises a tank to contain developer, said tank having an upper open-topped tray at its top containing the said developer plate therein, and by pump means to pump developer into the said upper tray to cover said developer plate and to subsequently drain the said upper tray to expose the said wetted developer plate, whereby to wet the said developer plate prior to developing an image by pressing the said plate to the said receptor member.

4. A colour copier according to claim 3 characterised by means to raise the said tank to press the said developer plate to the said receptor member.

5. A colour copier according to claim 3 characterised by resilient support means between the said developer plate and the said tank whereby to select the pressure applied between the said developer plate and the said receptor member.

6. A colour copier according to claim 1 characterised by a plurality of developer stations each comprising a tank to contain developer and above the said tank an open-topped tray having a developer plate therein, and submerged pump means in said tank to pump developer into said tray, an overflow from said tray back to said tank whereby to maintain a developer level to submerge said plate only while the said pump operates but to expose the wetted plate when developer flows back through non-operation of the said pump, and resilient support means between the floor of the said tray and the said developer plate to reliably support the said plate in the said tray.

7. A colour copier according to claim 6 characterised by means to raise the said developer plate to cause it to press against the said receptor member when the said carriage positions the said receptor member above the said developer plate.

8. A colour copier according to claim 7 wherein the said tray forms an upper part of the said tank and is raised by means engaging a frame supporting the said tank.

9. A colour copier according to claim 1 wherein the means to remove the excess developer comprises an air knife on each tank on the exit side of the said tank in relation to carriage movement after a developer application, said air knife comprising a jet directed to discharge excess developer back into said tank, said jet being connected to air supply means.

10. A colour copier according to claim 1 wherein the means to remove the excess developer comprise a squeegee roller on each tank on the exit side of the said tank in relation to carriage movement after a developer application, said squeegee roller being disposed to discharge excess developer back into the said tank.

* * * * *